US005918485A

United States Patent [19]

Fischer et al.

[11] Patent Number: 5,918,485

[45] Date of Patent: Jul. 6, 1999

[54] WARP KNITTING MACHINE WITH SELECTIVE GUIDE BAR STOPS

[75] Inventors: Joachim Fischer, Rodgau; Kresimir Mista, Heusenstamm, both of Germany

[73] Assignee: Karl Mayer Textilmachinenfabrik GmbH, Obertshausen, Germany

[21] Appl. No.: 08/985,689

[22] Filed: Dec. 5, 1997

[30] Foreign Application Priority Data

Dec. 9, 1996 [DE] Germany ..... 196 51 053

[51] Int. Cl.[6] ..... D04B 27/32

[52] U.S. Cl. ..... 66/205

[58] Field of Search ..... 66/205, 204, 207; 310/330, 331

[56] References Cited

U.S. PATENT DOCUMENTS

| | | | |
|---|---|---|---|
| 4,549,414 | 10/1985 | Zorini et al. . | |
| 4,570,462 | 2/1986 | Roth | 66/204 |
| 5,390,512 | 2/1995 | Mista | 66/205 |
| 5,491,988 | 2/1996 | Hohne et al. | 66/204 |
| 5,533,366 | 7/1996 | Mista et al. | 66/205 |
| 5,553,470 | 9/1996 | Hohne et al. . | |

FOREIGN PATENT DOCUMENTS

| | | |
|---|---|---|
| 2707015 | 8/1978 | Germany . |
| 299384 | 10/1983 | Germany . |
| 4028390 | 3/1992 | Germany . |
| 4337265 | 3/1995 | Germany . |
| 44 14 876 | 5/1996 | Germany . |
| 4442555 | 6/1996 | Germany . |
| 4444823 | 6/1996 | Germany . |
| 8501527 | 4/1985 | WIPO . |

OTHER PUBLICATIONS

European Search Report, dated Mar. 25, 1998, EP 97 12 0683.

*Primary Examiner*—Andy Falik
*Attorney, Agent, or Firm*—Omri M. Behr, Esq.

[57] ABSTRACT

A warp knitting machine comprises a jacquard guide bar (102) whose guides (7) are movable to and fro between two end stops (113 and 114). This motion is effected by setting members of a guide control. The end positions of the guides have a separation equal to two needle spaces. Additional strikers (115) and (116) are, at choice, made operative by the setting members (transducer 108) of a stop control. When one of the additional strikers is in an operative position, that striker holds the guide (7) in a central position. In particular, needle control and stop controls may operate with piezo-electric transducers. In this manner, it is possible to obtain an extremely large number of patterning possibilities.

23 Claims, 3 Drawing Sheets

WARP KNITTING MACHINE WITH SELECTIVE GUIDE BAR STOPS

BACKGROUND OF THE INVENTION

1. Field of the Invention

The present invention relates to a warp knitting machine with needles having a predetermined separation, and at least one jacquard guide bar whose guides, by means of a guide control mechanism operating on a setting means, may be moved to and fro between two end positions which are defined by outer end stops in the bar direction.

2. Description of Related Art

In warp knitting machines of this type, each guide may be displaced from one needle gap to the next, that is to say, by one needle space. The two positions are determined by whether the guide is, by choice, brought into contact with the left or the right end stop. The displacement may take place via harness-cord-operable displacing elements (DE 40 283 90 A1) by piezoelectric transducers (DE 42 268 99 C1) or other methods known to the art. This controllable single needle displacement in combination with a displacement of the entire jacquard bar, gives rise to a substantial number of patterning possibilities.

The purpose of the present invention is to provide a warp knitting machine of the general category described above which, however, has even larger patterning possibilities.

This task is solved by the present invention in that the end positions have a separation equal to double the needle gap and are furthermore provided with additional stops which may be made operative as desired by the setting means of a stop control mechanism and, in their operative position, hold the needles in a middle position.

SUMMARY OF THE INVENTION

In accordance with the illustrative embodiments demonstrating features and advantages of the present invention, there is provided a warp knitting machine having a needle bed with predetermined needle separation. The machine has at least one jacquard guide bar with a plurality of guides. The machine also has a guide control with a plurality of setting means for reciprocating the jacquard guides in a direction along the bar. Also included is a plurality of stop means, including striker control means and a plurality of pairs of outer end stops. Each of these pairs of outer end stops is effectively spaced two needle spaces and can limit motion along the bar of a corresponding one of the guides. The striker control means has a plurality of additional stops and a plurality of setting members for selectively activating the additional stops. Each of the additional stops in its operating position is operable to limit one of the guides from moving past a central position.

In a preferred construction, each guide may have three different positions, that is to say, the two end positions and the middle position and thus may be aligned with three neighboring needle gaps. This makes it possible to provide a large number of novel patterning possibilities, using for example in combination, a jacquard guide bar together with a cam plate, pattern drive, or the like, which cause sidewards displacement of the bar. In order to achieve single needle displacement, the methods known to the prior art may be retained, since the forces which displace the guides from one end position to the other also hold the guides against the additional stops placed in their movement path and thus define the middle position.

It is desirable that the setting members of the stop control are displaceable transverse to the plane of motion of the guides. This enables a mechanically, very simple preferred control of the additional stops.

In one embodiment, additional stops surround the guides in a fork-like manner and are attached to the end of a two-armed lever, and wherein a striker may be selectively introduced into the path of the other end of the lever by a setting member.

A similarly preferred alternative exists wherein a block which is displaceable by a setting member into a forward and a rearward position, is provided (a) in the forward part of a forward path between an end stop and a first additional stop, (b) in the rearward portion of a rearward path between the other end stop and a second additional stop, as well as (b) in a passage between the paths bracketed by the additional stops.

It is advantageous that the setting members of the guide control means are first piezoelectric transducers which are held tightly to the bar, at one of their ends and carry the guides at the other ends thereof. Such transducers take comparatively little space so that the setting members of the stop control means may also be relatively easily accommodated.

Furthermore, it is advantageous to provide that the first transducer is switchable between a left and a right deflection position. The transducers are thus pressed with equal force against the end stops and with slightly higher force against the additional stops.

It is advantageous to provide second piezoelectric transducers as the setting means for the stop control mechanisms. One end of the second transducers are held tight to the bar and the free end operates upon the additional stops. These setting means are also provided in a very space-efficient manner.

In particular, these second transducers may carry at free ends thereof the previously mentioned strikers or the previously mentioned block.

It is desirable that the stroke of the second transducers be limited by transverse stops attached to the bar. These transverse stops prevent the forces generated by the transducers from being transferred to the guides. This avoids friction as well as excessive strain on material. Furthermore, it is desirable to provide the second transducers to be switchable between a forward and a rearward deflection position. This has substantial advantages in control.

It is further advantageous to provide the second transducers between the carrier of the guide bar and the first transducers. The second transducers can be provided with their flat side close to the carrier and take up substantially no additional room. Three needle spaces are available to the width of the strip-formed transducers since each guide can take up three separate positions.

It is also advantageous to provide two different types of segments to be attached to the guide bar, which carry a predetermined number of first and second transducers. These segments make it possible to mount the first and the second transducers outside the warp knitting machine and, after inclusion, to connect them to the remaining striker steering means via cable bundles.

In particular, the segments should carry sixteen first and sixteen second transducers. Such entities allow favorable operation through digital control mechanisms.

An optimal patterning possibility is obtained when one utilizes at least three jacquard guide bars. By this means all of the various needle spaces can be served with jacquard controlled guides.

It is particularly advantageous to provide that adjacent middle positions have a separation of four needle spaces. This makes it possible to operate with but half the number of jacquard guides. In this case, for complete machine coverage, four partial jacquard bars are required.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
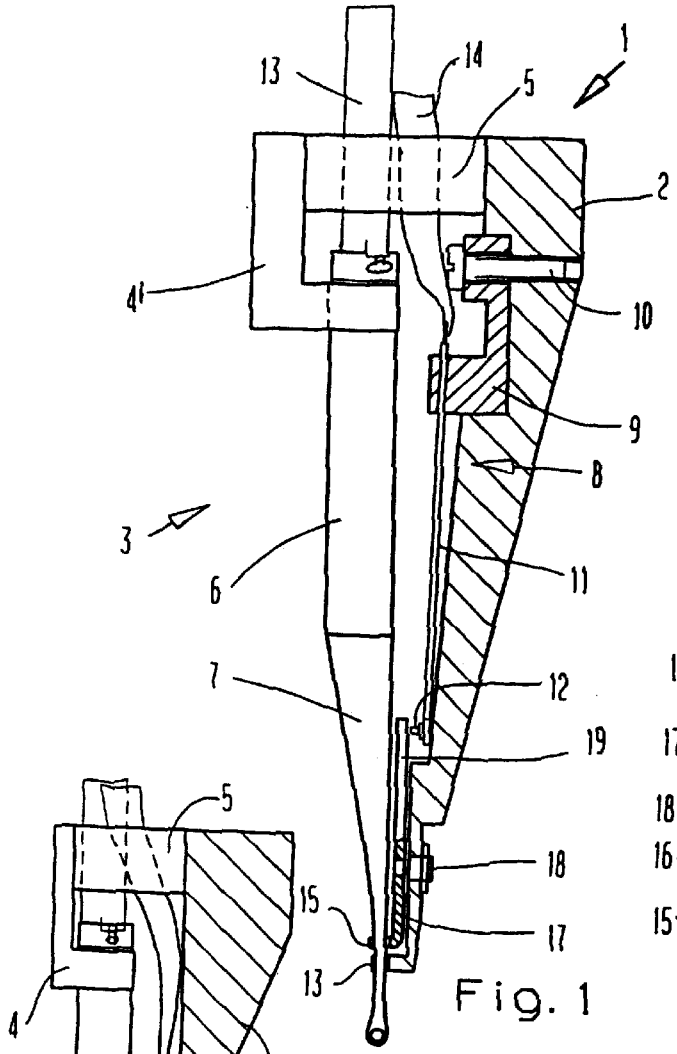
FIG. 1 is a partial, cross-sectional, side elevational view employing a jacquard guide bar in accordance with principles of the present invention.
Figure 2:
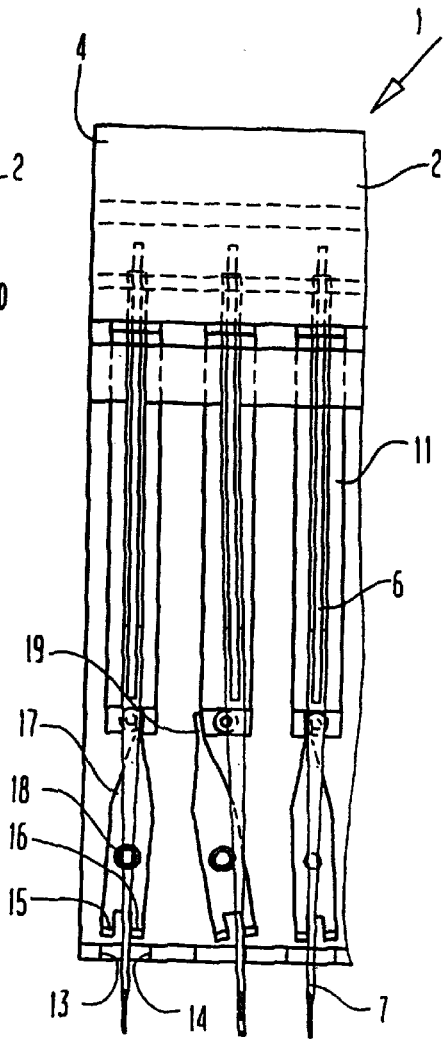
FIG. 2 is a front elevational view of a portion of the jacquard guide bar of FIG. 1.

FIGS. 1 and 2 illustrate a jacquard guide bar (1) having a carrier (2). A first transducer unit (3) comprises an angled segment (4), which is connected to carrier (2) via a connection piece (5). The segment (4) carries sixteen first. piezoelectric transducers (6), which each carry a guide (7) at their free end. A second transducer entity (8) likewise comprises an angled segment (9) which is attached to carrier (2) via screw (10). The segment carries sixteen, second piezoelectric transducers (11), which each have an abutment (12) at the free end thereof. Second transducer (11) is referred to as a setting means of a striker control means. Cable bundles (13) and (14) serve to connect the transducer units (3) and (8) with the appropriate control arrangements after their mounting on segments (4) and (9).

Left stops (13) and right stops (14) are part of a stop means provided to carrier (2), against which the guides (7) may rest under the influence of the appropriate transducer (6), as is shown in FIG. 2. Additional stops (15) and (16) (also part of a stop means) are provided at the lower end of a dual-armed lever (17) which is swingable about a fulcrum (18) attached to the bar and whose upper end (19) extends into the region of the abutment (12).

In the position shown in FIG. 1, the second transducer (11) and its abutment (12) do not influence the lever (17). Thus, upon activation of the transducer (6), it is free to carry the appropriate guide (7) along, as is shown for the middle lever (17) in FIG. 2. When, on the other hand, the abutment (12), by activation of the second transducer (11) is moved into the motion path of the lever end (19), the lever (17) is stopped. In this circumstance, the additional stops (15) and (16) are operative to hold the guide (7) in the middle position. If the guide is moved from the right end stop (14) toward the left end stop (13), it is the additional stop (15) which fixes the guide (right guide (7) in FIG. 2).

On the other hand, where the guide (7) is moved from the left end stop (13) in the direction of the right end stop (14), the right additional stop (16) is activated (left guide (7) in FIG. 2).

Figure 3:
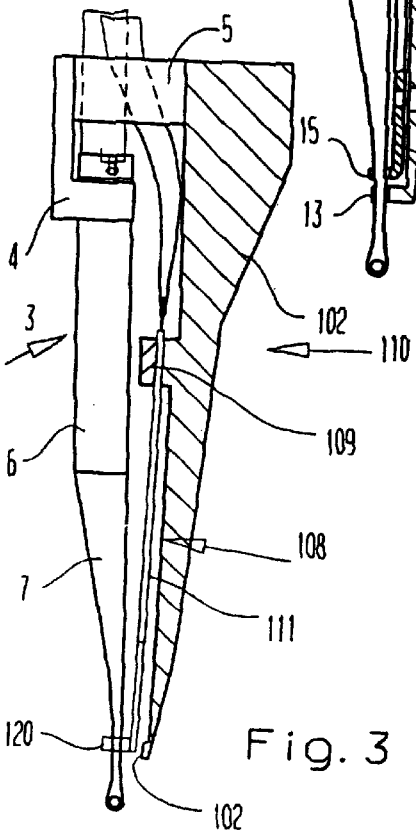
FIG. 3 is a partial, cross-sectional, side elevational view of an embodiment that is an alternate to the guide bar of FIG. 1.
Figure 4:
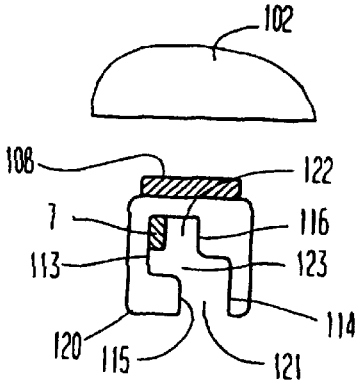
FIG. 4 is a partial, downward plan view of the embodiment of FIG. 3 showing the end of the guide in one end position.
Figure 5:
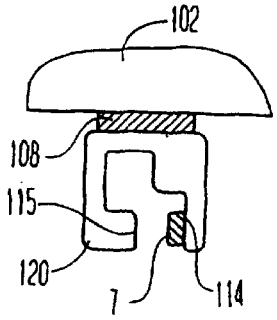
FIG. 5 is a partial downward plan view of the embodiment of FIG. 3 showing the end of the guide in the other end position.

In the embodiments of FIGS. 3 through 5, the same numbers are used for identical parts, and for functionally equivalent parts, the item numbers are raised by 100. Thus, it is seen that at the free end of second transducer (111 ) there is provided in each case a block (120), which can be displaced by transducer (111) into a forward position (FIG. 4) and into a rearward position (FIG. 5). The forward position of the block (120) comprises a forward path (121 ) which is bordered by a first outer end stop (114) and by an additional stop (115). Furthermore, a rearward path (112) is bordered by an end stop (113) and an additional stop (116), as well as a transition path (112) from one path to the other. Three possibilities may be operated.

a) When block (120) finds itself in the forward position, the guide (7) can lie either at end stop (113) or by activation of the appropriate transducer (6) can rest against the additional stop (116) in the central position.

b) When block (120) is in the rearward setting, guide (7) can either lie against end stop (114) or against additional stop (115) in the central position.

c) When guide (7) should alternate between the two end positions, the two transducers (6) and (111) must be activated so that guide (7) traverses the transition path (123).

Figure 7:
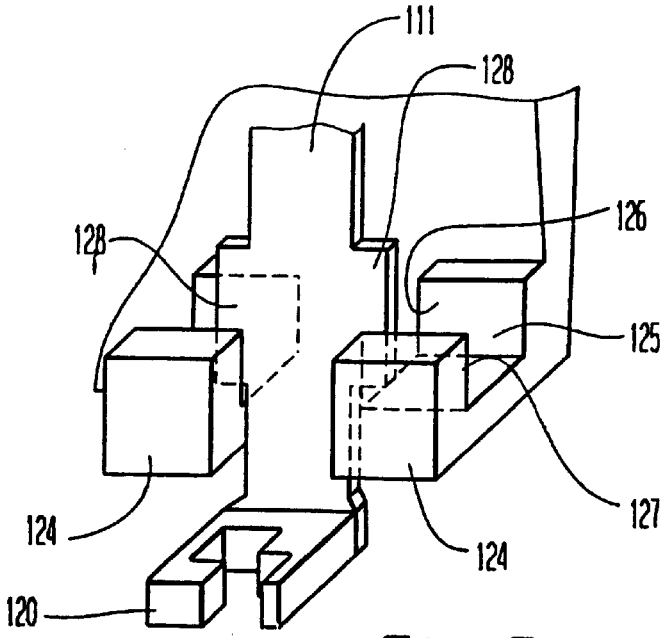
FIG. 7 is an detailed, perspective, partial, front elevational view of the embodiment of FIG. 6.
Figure 6:
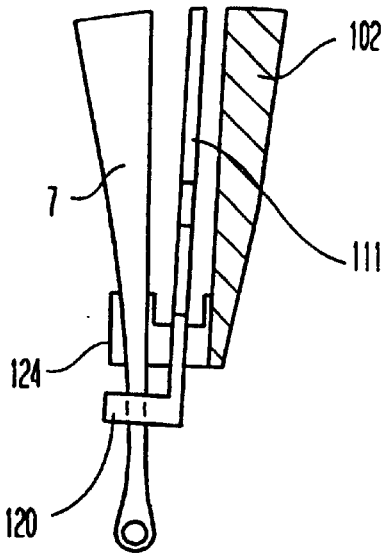
FIG. 6 is a partial, cross-sectional, elevational view of a further embodiment of a jacquard guide bar similar to that of FIG. 1.

FIGS. 6 and 7 correspond to examples illustrated in FIGS. 3 through Here however, carrier (102) is provided with transverse stops(124), comprising slots (125) bordered by cross flanges (126) and (127). In these slots the side extenders (128) restrain the free end of second transducer (111). By means of these cross flanges (126) and (127), the transverse movement of blocks (120) from front to back and per contra is defined. In block (120) no forces of the transducer (111) operate on guides (7), which guarantees a long operative life.

Figure 8:
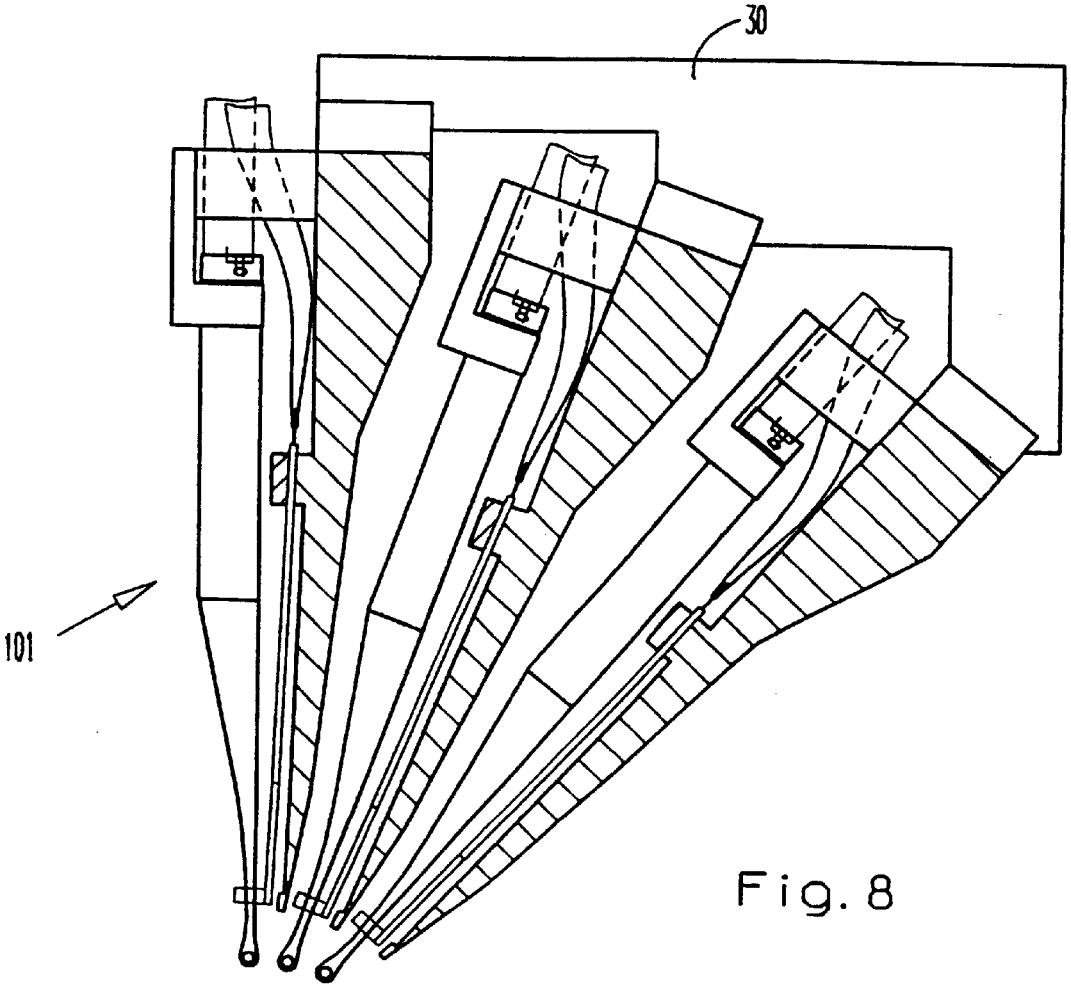
FIG. 8 is a partial, cross-sectional, side elevational view of the guide bar environment of the warp knitting machine of the present invention.

FIG. 8 illustrates three jacquard guide bars (101), each of which are constructed in accordance with FIGS. 3 through 5. These three guide bars have guides (7) so displaced with respect to each other, that when all guides (7) are in the middle position, a guide is provided to each needle space. These three guide bars are rigidly attached to the machine frame by means of a bridge (30), whereby the relative swing motion through the needles occurs. It is however also possible that each guide bar can be individually displaced in the longitudinal direction by a displacement control means. Furthermore, it is also possible to permit the bar package to swing through needles in a fixed position.

Figure 9:
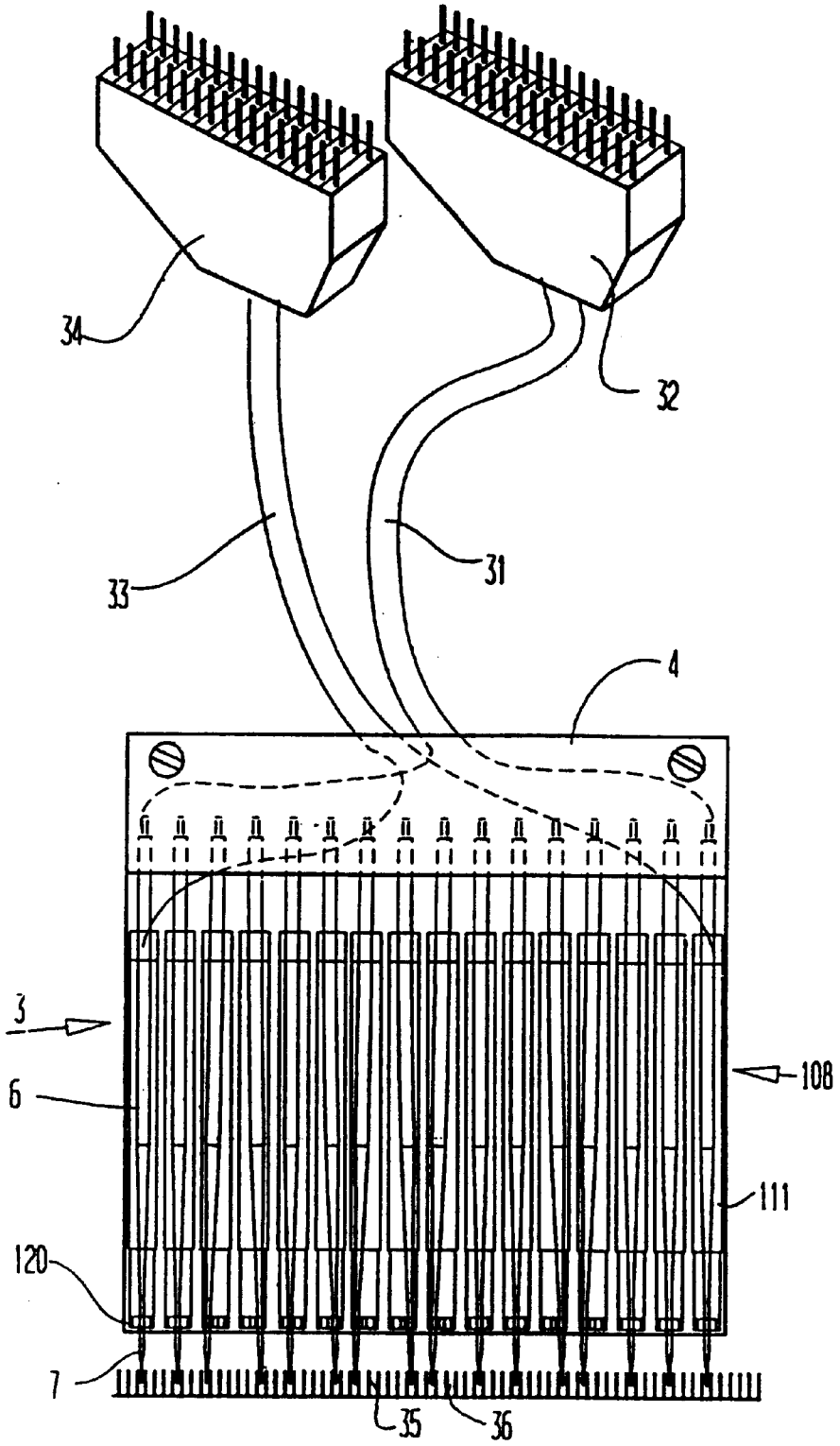
FIG. 9 is a front elevational view of a sector having the appropriate transducers installed therein and schematically illustrating their positioning relative to the needle bed.

In the embodiment in accordance with FIG. 9, there is illustrated a transducer unit (3) with an appropriate segment (4), which carries a total of sixteen, first transducers. These are connected via a cable bundle (31) with a 17-pin plug (32). Rearwardly thereof, it is indicated that sixteen, second transducers (111) are provided which control the blocks (120). These transducers are connected via cable bundles (33) with a 17-pin plug (34). Needle bed (35) is indicated (schematically), through whose gaps (36), guides (7) may swing. When all guides (7) are located in the middle position, each fourth gap (36) is provided with a guide (7). Utilizing four similarly arranged guide (7) but displaced by one needle gap, it is possible to serve various needle gaps (36) simultaneously.

Many embodiments are possible as variations from the illustrated embodiment, without departing from the basic principles of the present invention. In particular, guides (7) can be displaced by different means than piezoelectric transducers, for example, this may be achieved by displacement rods or sinkers or return springs. Furthermore, the control of the additional stops can also be achieved in a purely mechanical manner.

Obviously, many modifications and variations of the present invention are possible in light of the above teachings. It is therefore to be understood that within the scope of the appended claims, the invention may be practiced otherwise than as specifically described.

We claim:

1. Warp knitting machine having a needle bed with predetermined needle separation, comprising:

at least one jacquard guide bar having a plurality of guides;

a guide control having a plurality of setting means for reciprocating said guides in a direction along said bar; and a plurality of stop means, including:

(a) a plurality of pairs of outer end stops, each pair effectively spaced two needle spaces for limiting motion along said bar of a corresponding one of said guides; and (b) a striker control means having a plurality of additional stops and a plurality of setting members for selectively activating said additional stops into an operating position, each of said additional stops in its operating position being operable to limit one of the guides from moving past a central position.

2. Warp knitting machine in accordance to claim 1, wherein the guide control is operable to reciprocate the guides in a motion plane, the setting members of the striker control means being operable to displace said additional stops transversely to the motion plane of the guides.

3. Warp knitting machine in accordance with claim 2, wherein the striker control means comprises:

a plurality of dual-armed levers, said setting members of said striker control means having a plurality of abutments adapted to be selectively introduced into a path traveled by one end of the levers, the other end of the levers having additional strikers that are arranged in a fork-like manner to straddle the guides.

4. Warp knitting machine in accordance with claim 3 wherein the setting means of the guide control each comprise:

a first piezoelectric transducer having one end rigidly affixed to the bar and another end carrying one of the guides.

5. Warp knitting machine in accordance with claim 4 wherein the guide control is operable to switch the first piezoelectric transducer into a left and into a right deflected position.

6. Warp knitting machine in accordance with claim 3 wherein the setting members of the striker control means each comprise:

a piezoelectric transducer having a fixed end rigidly affixed to the bar and a free end arranged to operate on the additional stops.

7. Warp knitting machine in accordance with claim 6, wherein the piezoelectric transducer comprises:

an abutment projecting from the free end thereof.

8. Warp knitting machine in accordance with claim 7, comprising:

a plurality of transverse flanges rigidly affixed to the bar for limiting the extent of stroke of the transducers.

9. Warp knitting machine in accordance with claim 8, wherein the striker control means is operable to switch the piezoelectric transducer between a forward and a rearward deflected position.

10. Warp knitting machine in accordance with claim 2, wherein said stop means further include:

a plurality of blocks each displaceable by the setting members of the striker control means between a, forward position and a rearward position, each of the pairs of end stops having: (a) for the forward position, a forward path between a first corresponding one of the additional stops and one of the end stops, (b) a rearward path between the other one of the end stops and a second corresponding one of the additional stops of the corresponding one of the pairs, and (c) between said forward path and said rearward path, a transition path bordered by the first and the second corresponding ones of the additional stops.

11. Warp knitting machine in accordance with claim 10 wherein the setting means of the guide control each comprise:

a first piezoelectric transducer having one end rigidly affixed to the bar and another end carrying one of the guides.

12. Warp knitting machine in accordance with claim 10 wherein the setting members of the striker control means each comprise:

a piezoelectric transducer having a fixed end rigidly affixed to the bar and a free end arranged to operate on the additional stops.

13. Warp knitting machine in accordance with claim 12, wherein each of the blocks are mounted on the free end of the piezoelectric transducer of a corresponding one of the setting members of the striker control means.

14. Warp knitting machine in accordance with claim 13, comprising:

a plurality of transverse flanges rigidly affixed to the bar for limiting the extent of stroke of the transducers.

15. Warp knitting machine in accordance with claim 14, wherein the striker control means is operable to switch the piezoelectric transducer between a forward and a rearward deflected position.

16. Warp knitting machine in accordance with claim 11 wherein the guide control is operable to switch the first piezoelectric transducer into a left and into a right deflected position.

17. Warp knitting machine in accordance with claim 1 wherein the setting members of the striker control means each comprise:

a piezoelectric transducer having a fixed end rigidly affixed to the bar and a free end arranged to operate on the additional stops.

18. Warp knitting machine in accordance with claim 17, wherein the striker control means is operable to switch the piezoelectric transducer between a forward and a rearward deflected position.

19. Warp knitting machine in accordance with claim 1, wherein the guide bar has a carrier supporting the guides, the setting means of the guide control each comprising:

a first piezoelectric transducer having one end rigidly affixed to the bar and another end carrying one of the guides, the setting members of the striker control means each comprising:

a second piezoelectric transducer having a fixed end rigidly affixed to the bar and a free end arranged to operate on the additional stops, the second piezoelectric transducer being mounted between the carrier of the guide bar and the first transducer.

20. Warp knitting machine in accordance with claim 1, wherein the setting means of the guide control each comprise:

a first piezoelectric transducer having one end rigidly affixed to the bar and another end carrying one of the guides, the setting members of the striker control means each comprising:

a second piezoelectric transducer having a fixed end rigidly affixed to the bar and a free end arranged to operate on the additional stops, the warp knitting machine comprising:

a first and a second segment attached to said guide bar for supporting said first and said second transducers, respectively.

21. Warp knitting machine in accordance with claim 20, wherein the first and the second transducers are mounted in groups of sixteen on the first and the second segments, respectively.

22. Warp knitting machine in accordance claim 21, wherein said guide bar comprises:

at least three jacquard guide bars.

23. Warp knitting machine in accordance with one of claim 22, wherein adjacent ones of the stop means of the guide bar have their central positions effectively separated by four needle spaces.

* * * * *